United States Patent [19]

Wood

[11] 4,420,159

[45] Dec. 13, 1983

[54] PACKER VALVE ARRANGEMENT

[75] Inventor: Edward T. Wood, Kingwood, Tex.

[73] Assignee: Completion Tool Company, Houston, Tex.

[21] Appl. No.: 407,898

[22] Filed: Aug. 13, 1982

[51] Int. Cl.[3] ..... E02D 5/00; E21B 33/12

[52] U.S. Cl. ..... 277/34; 166/151; 166/187

[58] Field of Search ..... 277/34, 34.3, 34.6; 166/151, 187

[56] References Cited

U.S. PATENT DOCUMENTS 3,527,296 9/1970 Malone ..... 277/34

4,260,164 4/1981 Baker et al. ..... 277/34

*Primary Examiner*—Robert I. Smith

[57] ABSTRACT

A valve system for use in inflating packers mounted on mandrels is disclosed. The valve system uses one or more valves to permit, through the use of seals, the flow of fluid form the interior of a tubular mandrel to the interior of the inflatable packer when pressure applied in the mandrel exceeds at least a minimum pressure. In two embodiments, inflation of the packer beyond a given pressure is prevented. In all embodiments, the differential pressure across reciprocating seals is minimized through exposure of one or both sides, directly or indirectly, to the external pressure of the mandrel and packer.

13 Claims, 13 Drawing Figures

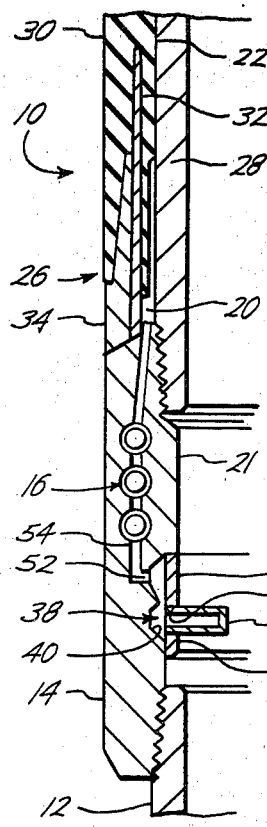
Fig. 2
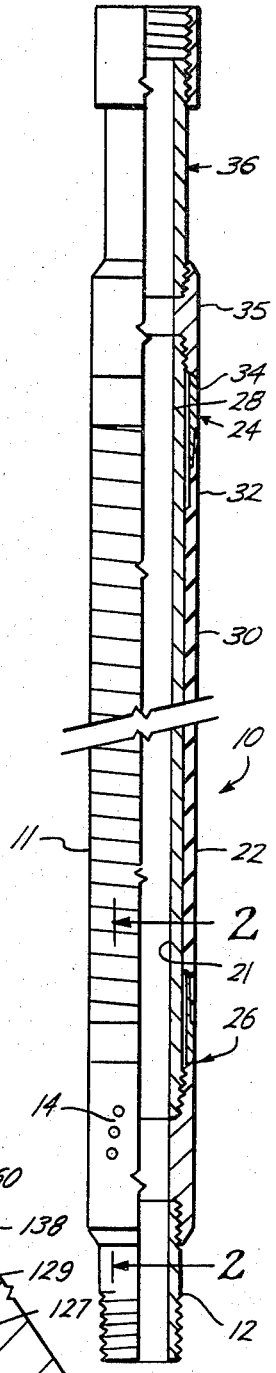
Fig. 1
Fig. 3
PRIOR ART
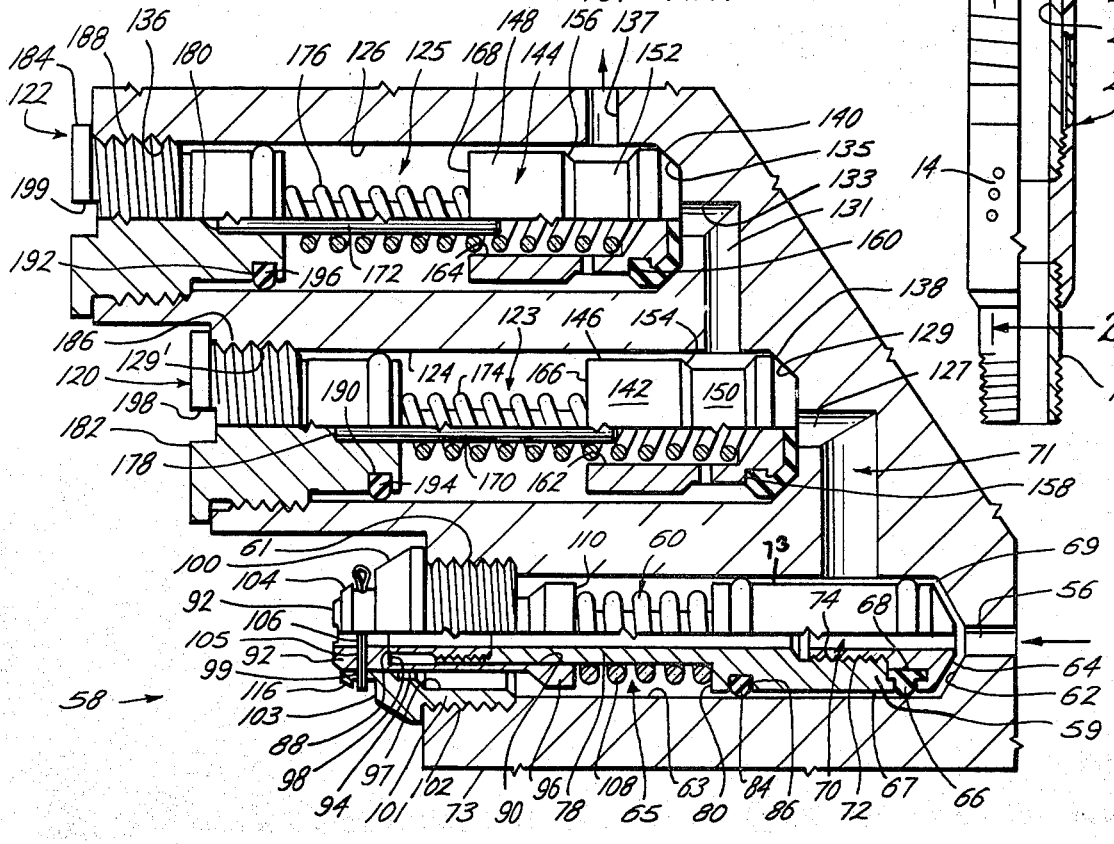

Fig. 8A
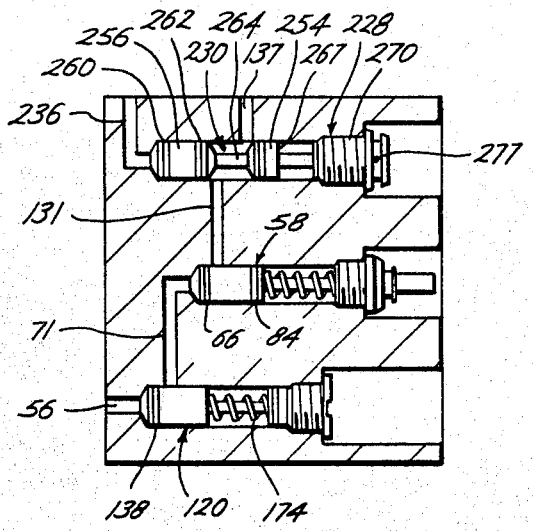
Fig. 8B
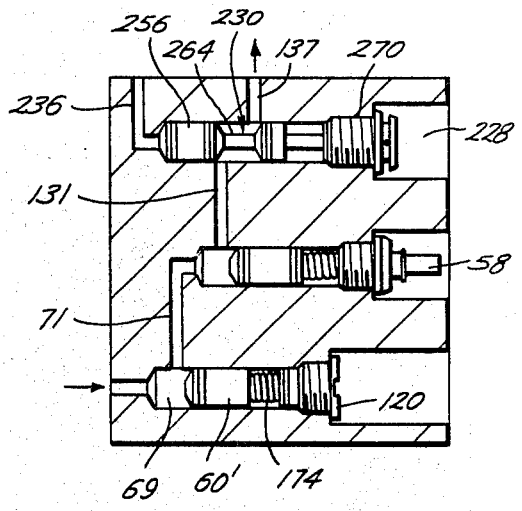
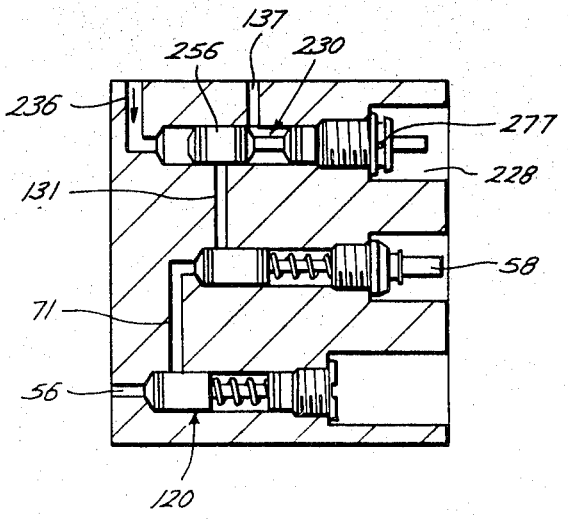
Fig. 8C

Fig. 9A
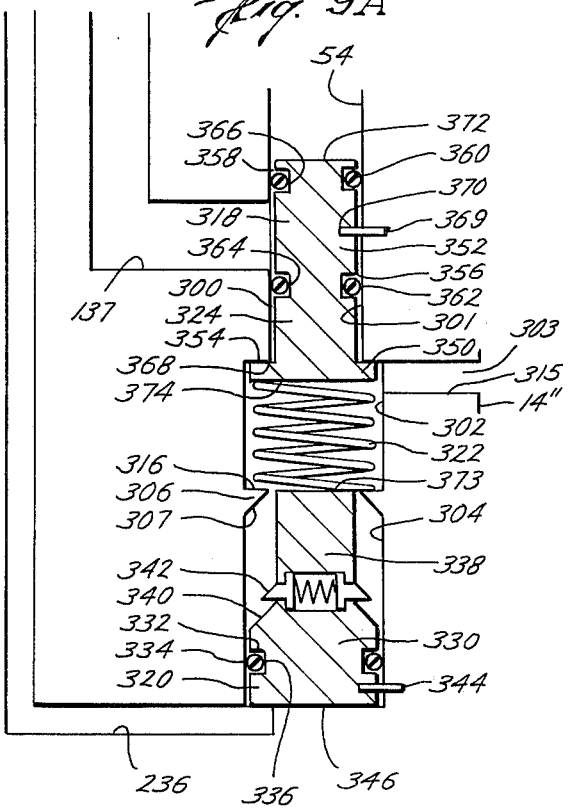
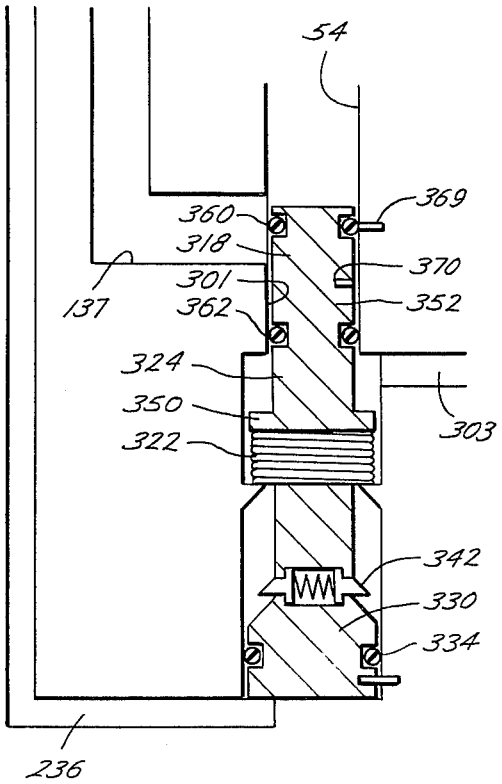
Fig. 9B
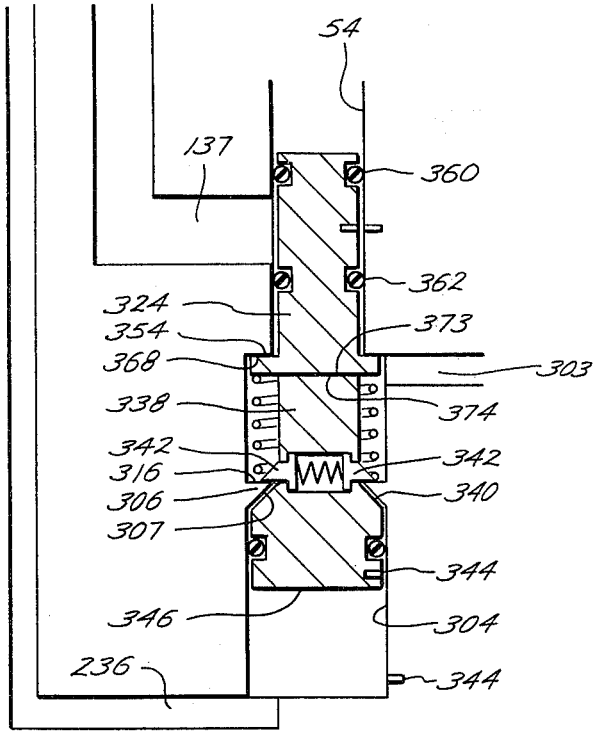
Fig. 9C

PACKER VALVE ARRANGEMENT

BACKGROUND OF THE INVENTION

1. Field of the Invention

The present invention relates to packer inflation systems and more particularly to the valves which control the inflation of packers.

2. Description of the Prior Art

The control of the inflation of well packers is important to obtain integrity between the packer and the well bore for purposes of working within the bore. It is known in the art to inflate packers by various mechanisms. See, for example, U.S. Pat. No. 3,503,445, issued Mar. 31, 1970, to K. L. Cochran et al. entitled "Well Control During Drilling Operations"; U.S. Pat. No. 3,351,349, issued Nov. 7, 1967, to D. V. Chenoweth, entitled "Hydraulically Expandable Well Packer"; U.S. Pat. No. 3,373,820, issued Mar. 19, 1968, to L. H. Robinson, Jr. et al, entitled "Apparatus for Drilling with a Gaseous Drilling Fluid".

In U.S. Pat. No. 3,437,142, issued Apr. 8, 1969, to George E. Conover, entitled "Inflatable Packer for External Use on Casing and Liners and Method of Use", there is disclosed an inflatable packer for external use on tubular members such as casings, liners, and the like. A valving arrangement is disclosed therein for containing fluid within the interior of the inflatable member after it has been inflated to prevent its return to the tubular member.

Arrangements of valving have been known in the prior art to prevent further communication between the interior of the tubular member and the interior of the inflatable element after the inflatable element has been inflated and set in a well bore. See, for example, U.S. Pat. No. 3,427,651, issued Feb. 11, 1969, to W. J. Bielstein et al, entitled "Well Control"; U.S. Pat. No. 3,542,127, issued Nov. 24, 1970, to Billy C. Malone, entitled "Reinforced Inflatable Packer with Expansible Back-up Skirts for End Portions"; U.S. Pat. No. 3,581,816, issued June 1, 1971, to Billy C. Malone, entitled "Permanent Set Inflatable Element"; U.S. Pat. No. 3,818,922, issued June 25, 1974, to Billy C. Malone, entitled "Safety Valve Arrangement for Controlling Communication Between the Interior and Exterior of a Tubular Member"; and U.S. Pat. No. 3,776,308, issued Dec. 4, 1973, to Bill C. Malone, entitled "Safety Valve Arrangement for Controlling Communication Between the Interior and Exterior of a Tubular Member".

Inflatable packers have also been used in other operations, such as sealing the annular space between a jacket and a piling. See for example U.S. Pat. No. 4,063,427, issued Dec. 20, 1977, to Erwin E. Hoffman, entitled "Seal Arrangement and Flow Control Means Therefor".

The seals that are used in valves, such as in Malone, are usually hardened rubber. Such rubber tends to extrude under extreme pressure differential across the rubber and cause friction between rubber and metal that adversely affects valve operation. None of the prior art, however, provides for mechanism for equalizing pressures across the seals of the valves used to inflate packers to prevent such extrusion.

SUMMARY OF THE INVENTION

The present invention utilizes a unique arrangement of sealing mechanisms in conjunction with a valve or valves to permit the inflation of an inflatable packer element while at the same time equalizing pressure around the rubber seals of the valve or valves to prevent distortion of the seals from undue high differential pressure, and the resulting friction.

The present invention, like the prior art, is constructed and arranged so that the valve or valves remain seated to prevent communication between the interior of a tubular member and the interior of an inflatable element carried on the exterior of the tubular member until at least a predetermined pressure has been reached. This reduces the possibility of premature inflation of the inflatable element by sudden pressure changes or pressure surges which may occur within the tubular member as the tubular member is being positioned within a well bore.

However, the valve arrangement of the inflation system of the present invention includes an appropriate arrangement of the valve structure to compensate for bore pressure to prevent extrusion from undue high differential pressures across the seals of certain rubber seals which must move in the valving operation.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 1 is a cross-section of a packer showing the three-valve collar for inflation of the packing;

FIG. 2 is an enlarged cross-section of the valve arrangement of FIG. 1 taken along section line 2—2 of FIG. 1;

FIG. 3 is an enlarged cross-sectional view of the three valves of a three-valve arrangement within the three-valve collar of the prior art;

FIGS. 8*a–c* are enlarged pictoral view of the sequence of steps of inflation of the packer by the three-valve arrangement of FIG. 6 and FIG. 7 shown inverted to the normal position of insertion; and FIGS. 9*a–c* are a pictoral view of the cross-section of a third embodiment of the valve arrangement of the present invention showing the valve and the sequence of steps for inflation of the packer shown inverted to the normal position of insertion.

DETAILED DESCRIPTION OF THE PREFERRED EMBODIMENTS

Figure 4:
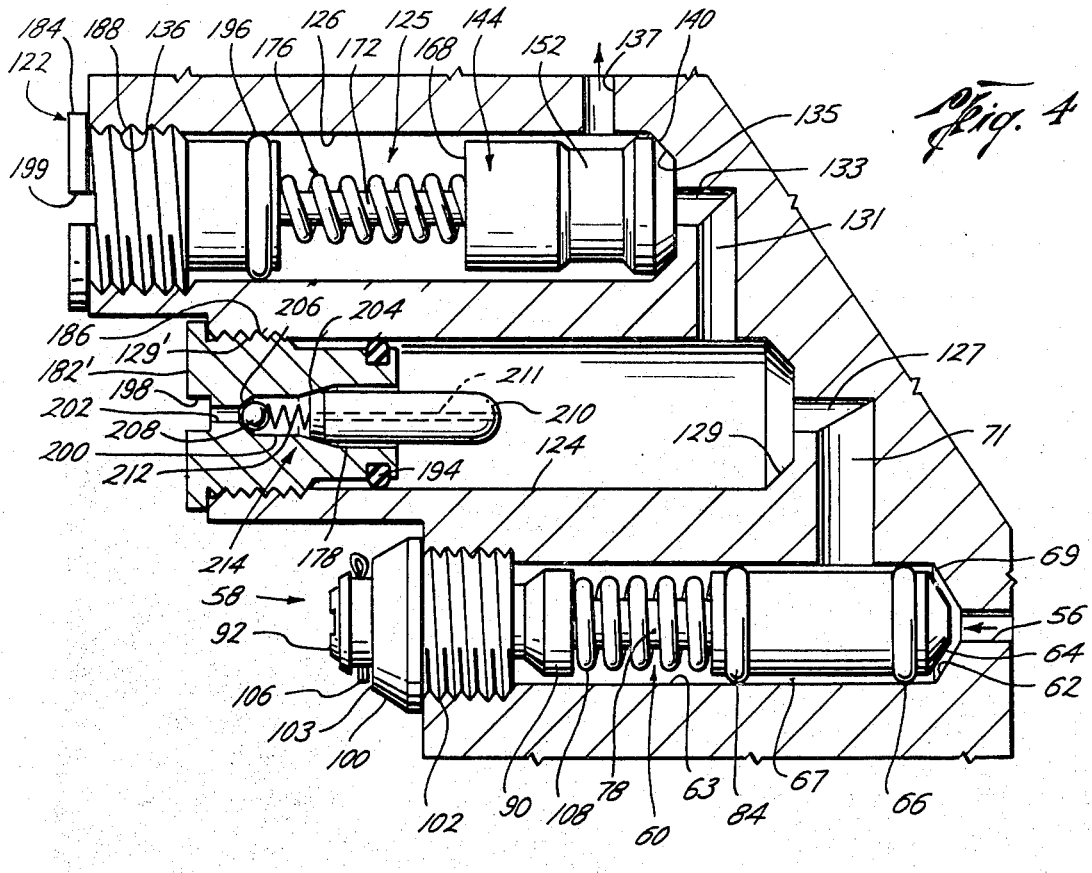
FIG. 4 is an enlarged cross-sectional view of three valves of a three-valve arrangement of the first embodiment of the present invention within the three valve collar.

A tubular member 10 is shown in FIGS. 1 and 2. This type of member could be used for any of the embodiments of the present invention and is specifically illustrated for embodiments 1 and 2, and may be a casing packer. Member 10 includes a short casing joint or casing sub 12 for connection to other tubular members and is secured by suitable means, such as threads as illustrated in FIG. 1, to a valve collar 14 secured to the body 11 of the tubular member 10. It should be noted that the valve collar 14 could also be and is preferably secured to the sub 36 of other end of body 11 shown in FIG. 1. Valve collar 14 includes valve mechanism 16 (FIG. 2) for communicating fluid from the interior 21 of tubular member 10 to the fluid channel 20 (FIG. 2) leading to the inflatable, or packing, element 22 carried externally on tubular member 10.

The inflatable element 22 includes spaced apart annular packer heads 24, 26. Lower head 26 is secured to valve collar 14. Upper head 24 is secured to top collar 35. Inflatable element 22 extends between heads 24, 26 and is also secured to mandrel 28 which extends along the inside surface of element 22 between valve collar 14 to upper collar 35 where mandrel 28 is connected by threading or other means. The inflatable element may be of any suitable length and is provided with an elastomer cover 30 and two sets of steel anti-extrusion ribs 32. Ribs 32 are connected to the cover 30, such as, for example, vulcanized into the rubber, and extend therein. Each set of ribs 32 is connected to a steel back-up sleeve 34, and one set is connected to valve collar 14 while the other set is connected to collar 35. Sleeve 34 is also connected to packing element 22, such as vulcanized with the rubber, and to valve collar 14. A sub 36 is connected to the other portion of collar 35 for use with other tubular members.

A first set of grooves 38 is formed on valve collar 14. The set of grooves 38 includes internal, circumferential grooves 40, 42 formed in valve collar 14. Grooves 40, 42 are partially covered by juxtaposed screen sleeve 44. Sleeve 44 includes a hole 46 covered by a knock-off rod 50, usually of plastic, to isolate the valve system from pressure in the interior 21 of the member 10 during running.

Groove 42 terminates in port 52 extending partially through the wall of the valve collar 14 and connecting to passageway 54. Passageway 54 extends vertically in the wall of valve collar 14 to the port 56 of the valve system.

Embodiment 1

Shear valve 58 (FIG. 3, FIG. 4) is in fluid communication with port 56 via insertion of valve 58 in pocket 60. Pocket 60 formed in valve collar 14 by drilling of other means. Valve pocket 60 is in fluid communication with port 56. Pocket 60 forms angled valve seat 62 at the end of pocket 60 in direct fluid communication with port 56. The other end of pocket 60 is threaded with threads 61. Pocket 60 is cylindrical in shape having upper surface 63 of one diameter in upper chamber 65 and coaxial surface 67 of a second, smaller diameter in lower chamber 69. Upper chamber 63 has an opening to lateral passageway 71 at one end which extends further into valve collar 14.

Valve 58 includes a cylindrical shaped body 59 with an end portion 64 shaped to fit in seat 62. A T-seal, or other suitable seal, 66 is included along the circumference 73 of body 59 in groove 68 of end portion 64. Seal 66 is adapted to engage the wall 67 of the lower chamber 69 substantially parallel to the circumference 73. A threaded bore 70 having internal threads 74 is formed longitudinally along the lower portion of body 59. End 64 is connected by external threads 72, or other suitable means, to internal threads 74 of the longitudinal bore 70. The valve body 59, as illustrated, is reduced in size at the end opposite to end portion 64 to form a valve stem 78 with a first shoulder 80 formed at the juncture of valve stem 78 and the valve body 59. A suitable seal 84, such as an O-ring, is arranged in groove 86 on the upper portion of valve body 59 between the end portion 64 and shoulder 80. Seal 84 is adapted to seal against the upper surface 63 of upper chamber 65 of pocket 60 and groove 86.

Valve stem 78 terminates at its top 88 which is adjacent collet 90. Collet 90 has thick top section 92 and an elongated sleeve 94 terminating in bell-shaped lower section 96. Sections 92 and 94 form an inner end 98 which abuts stem top 88. Collet 90, which abuts valve stem 78 at its inner end 98, is retained in pocket 60 by annular retainer housing 100 which annularly surrounds collet 90. Annular retainer housing 100 has a base 101 with threads 102 formed on the outer circumference thereof. Threads 102 mate with threads 61 which secures housing 100 to pocket 60. Housing 100 further has a bore 97 formed through base 101 to receive collet 90 and an opening 116 at its top through which section 92 extends.

A shear pin 106 extends through a bore 99 in notch 103 in the end 104 of the retainer housing 100 and a bore 105 in the end 92 of collet 90 as shown in FIGS. 3 and 4 to retain valve 58 in the seated position with end portion 64 adjacent seat 62 to block off fluid flow through port 56 from the interior 18 of the tubular member 10 to the fluid channel 20 leading to the interior of the inflatable element 30 via passageway 71.

A spring 108 surrounds valve stem 78 with one end of the spring abutting the shoulder 80 and the other end abutting the end 110 of the collet 90, such spring 108 being forced to a collapsed position as illustrated when the valve is in the position as shown in FIGS. 3 and 4 of the drawings.

The strength of shear pin 106 will determine the minimum amount of fluid differential pressure necessary in port 56 to unseat the valve 58 and permit fluid flow through the port 56 from the interior of tubular member 10 to the interior of packer element 30.

Seals 66, 84 are positioned such that when the valve 58 is in the seated position as shown in FIGS. 3 and 4, the seals 66, 84 prevent any fluid flow from port 56 to passageway 71. They also prevent the flow of any fluids from the exterior of collar 14 in contact with the bore hole which leak through threads 102 and past collet 90 in housing 100 into upper chamber 65 to flow into passageway 71. In addition, when the valve 58 is in the seated position, shoulder 80 is separated from bottom 110 by a sufficient distance such that when the valve 58 is no longer in the seated position but shoulder 80 is as close to shoulder 110 as the springs will allow, seal 66 is positioned above passageway 71.

In FIG. 3, valves 120 and 122 are substantially identical in construction. Valves 120, 122 are located in pockets 123, 125 respectively. Each pocket 123, 125 is substantially cylindrical in shape with walls 124, 126 respectively formed by drilling or other suitable means of opening with one end at the exterior outer surface of valve collar 14. The other end of pocket 123 terminates at portion 127 in fluid communication with the pocket 123 and passageway 71. Pocket 123 forms angled valve seats 129 at the end of pocket 123 in direct fluid communications with port 127. The other end of pocket 123 is threaded with threads 129'. Passageway 131 also formed in valve collar 14 extends laterally further into valve collar 14 from the wall of pocket 123 and is in fluid communication with pocket 123. The other end of pocket 125 terminates at port 133 in fluid communication with the pocket 125 and passageway 131. Pocket 125 forms angled valve seats 135 at the end of pocket 125 in direct fluid communications with port 133. The other end of pocket 125 is threaded with threads 136. Passageway 137 also formed in valve collar 14 extends laterally further into valve collar 14 from the wall of pocket 125 and is in fluid communication with pocket 125 and fluid channel 20.

Each of the poppet valves 120, 122 includes an end portion 138, 140 respectively of elastomer for engaging on seats 129, 135 respectively formed between ports 127, 133 and the walls or pockets 123, 125 respectively. Each valve 120, 122 has a valve body 142, 144 respectively. The general shape of each valve body 142, 144 is cylindrical in configuration. The body 142, 144 of each valve 123, 125 has an upper portion 146, 148 respectively and a lower, smaller diameter portion 150, 152 respectively with a swage 154, 156 respectively separating the upper and lower portions of valve body. The tops of elastomer ends 138, 140 are fitted into grooves 158, 160 respectively formed circumferentially in lower ends 150, 152 respectively to hold the elastomer ends on lower portions 150, 152 respectively. A bore 162, 164 is formed through the end 166, 168 respectively of valves 142, 144 facing away from seats 129, 135 and extends substantially through the valve bodies 142, 144 respectively. A valve stem 170, 171 is inserted in the bore 162, 164 respectively with a spring 174, 176 in its collapsed position circumferentially surrounding stems 170, 172 respectively.

Each valve stem 170, 172 is received in a bore 178, 180 respectively in retainer housing 182, 184 of valves 120, 122 respectively. Each retaining housing 182, 184 is externally threaded with threads 186, 188 adapted to mate with threads 129', 136 respectively of pockets 123, 125 respectively. Each housing 182, 184 also includes a slot 190, 192 sized to receive a sealing means 194, 196, such as an O-ring, to sealingly engage the walls 124, 126 of pockets 124, 125 and slots 190, 192 respectively. Each housing 182, 184 also includes a groove 198, 199 respectively cut out in the head for external access from valve collar 14.

In operation, when the rod 50 is still in place, any communication of fluid from the interior of tubular member 10 to the fluid port 56 of any of the prior art or the embodiments is prevented. This prevents pressure variations or pressure surges from acting through port 56 and unseating the valve which might prematurely inflate the element 30.

When it is desired to actuate the device of any of the embodiments and communicate fluid to the channel 20 of packing element 22 carried on the exterior of the casing or tubular member 10, any suitable means (not shown) may be dropped through member 10 so as to break or shear the rod 50 to permit fluid communication with the groove set 38.

Thereafter, fluid may be communicated through the grooves 40, 42, the port 52, and the passage 54 to the inlet port 56 between the inner and outer walls of the valve collar 14. The fluid pressure of this fluid acts upon the end portion 64 of the valve 58, and the pressure within the tubular member 10 may be increased so as to shear the pin 106 whereupon the valve body 59 moves to a position where seal 66 no longer obstructs the flow of fluid to passageway 71 from port 56 thereby permitting fluid flow from port 56 through passageway 71 to port 127. This longitudinal movement of body 59 causes the valve stem 78 as well as the collet 90 surrounding the end thereof to move outwardly through the opening 116 of the retainer housing 100, compressing spring 108 between the shoulder 80 and the end 110 of the collet 90. The flow of fluid to port 127 builds pressure on end 138. When the pressure on end 138 overcomes the break out friction of end 138 and the force to compress spring 174, valve body 142 rises so that end 138 no longer obstructs the flow of fluid from port 127 through passageway 131 to port 133. The flow of fluid to port 133 builds pressure on end 140, when the pressure on end 140 overcomes the break out friction of end 140 and the force to compress spring 176, valve body 144 rises so that end 140 no longer obstructs the flow of fluid from port 133 to passageway 137 to channel 20 and packer 30 inflates.

Those skilled in the art would believe that shear pin 106 would shear at a given pressure at port 56 depending only on the strength of the shear pin 106. However, this is not the case. At the time the tubular member 10 is lowered into the well, the pressure in passageway 71 is at atmospheric pressure. The same is true of the pressures in upper pocket chamber 65 and the pressure at port 56. However, as the tubular member 10 is lowered into the well, the pressure in upper pocket chamber 65 changes to that of the exterior of the well because there is no seal through retainer housing 100 as discussed above. In addition, as pressure within the tubular member 10 increases, the pressure at valve port 56 increases. However, there is no path for the rising pressure to enter passageway 71 and raise it above atmospheric. Accordingly, while the valve is seated, seals 66, 84 will tend to extrude toward passageway 71 because of the high differential pressure between the upper pocket chamber 65 and passageway 71, and between lower pocket chamber 69 and passageway 71. In such circumstance, the seal rings 66, 84 are locked and the pressure to overcome breakout friction to move body 59 then goes much higher. This is because the O-rings usually used in the prior art of FIG. 3 are designed to only hold 4,000 to 5,000 psi of differential pressure. In deep wells, this breakout friction would be very high and normally a discontinuity in breakout pressure is exhibited at wells having a depth which exhibit downhole pressures of 5,000 to 6,000 psi. In addition, as discussed above, the diameter of upper pocket chamber 65 is larger than lower pocket chamber 69. In the prior art, in order to overcome this difference in diameter, a sleeve is installed in upper pocket chamber 65. Nevertheless the sleeves may not be perfect and the remaining space in the upper pocket chamber 65 is elliptical in shape having a major and a minor diameter both larger than the diameter of lower pocket chamber 69. Therefore, the force of the pressure on seal 84 in upper pocket chamber 65 is greater than the force by an identical pressure acting on seal 66 from valve port 56.

Accordingly, as the well is deeper and the pressure in upper pocket chamber 65 increases, the amount of pressure required at port 56 may be far greater than anticipated by knowledge of the shear strength of shear pin 106 in order to cause shear pin 106 to shear.

To avoid the problems of the prior art of FIG. 3 the valve system is modified as shown in FIG. 4. The modifications include removal of shear valve 58 from pocket 60. In addition, valve 120 is also removed. After shear valve 58 is removed from pocket 60. All grease is removed from O-ring 84 and T-seal ring 66. The shear valve is then lubricated with Baker Tubing Seal Grease Number 499-26 which is not reactant with the O-ring seal 84 or the T-seal 66 at elevated temperatures. The shear valve 58 is then replaced in pocket 60 in the manner known in the prior art. Pocket 123 is then filled, preferably with water or other suitable substance, although it could be left unfilled.

A modified retainer housing 182' is then installed in pocket 123. The modified retainer housing 182' includes a bore 200 of smaller diameter than bore 178 drilled coaxially through bore 178. Housing 182' is further modified to include counter bore 202 coaxial with and of smaller diameter than bore 200 formed by drilling or other means through the approximate center of groove 198. The disparity of diameters causes downwardly, outwardly sloping shoulder 204 to be formed between bore 178 and bore 200 and downwardly, outwardly sloping shoulder 206 to be formed between bore 200 and bore 202. A ball 208 is located within housing 182' in close proximity to the opening of bore 202 facing bore 200. Ball 208 is held against shoulder 206 by compressed spring 212. Spring 212 is compressed by rod 210 which contains an internal longitudinal fluid passageway 211 extending therethrough and opening at each end. Rod 210 is inserted into bore 178 by hammering or other means to force the rod 210 into the entry of bore 200 where it is held by friction with spring 212 and ball 208 extending into cocurrent bore 200 such that ball 208 abuts the shoulder 206 and the rod 210 extends substantially into the shoulder 204 forming a check valve assembly 214.

In operation, the member 10 of the first embodiment of FIG. 4, when lowered into the bore hole, will cause the pressure in passageway 71 to be approximately the same as the pressure in upper pocket chamber 65 of bore 60. This is effected by the check valve assembly 214. As pressure from the bore hole acts on tubular member 10, and particularly on modified housing 182', fluid will flow from counter bore 202 through bore 200 to bore 178, around ball 208, through passageway 211 in hollow rod 210 and thence to pocket 123, port 127 and passageway 71. This will permit the fluid in pocket 123 to be maintained at the pressure approximately that surrounding the tubular member 10 which is substantially the pressure in the upper pocket chamber 65. Accordingly, the differential pressure between upper pocket chamber 65 and passageway 71 across seal 84 will be very small. Further, the pressure at port 56 will also initially be approximately that of the bore so that the differential pressure across seal 66 will be very small. In addition, as the pressure in port 56 increases, and pin 106 shears, causing body 59 to move such that seal 66 moves to a position longitudinally above passageway 71, the pressure in pocket 123 will increase causing ball 208 to seat on the shoulder 206 thereby stopping further fluid communication between bore 200 and bore 202. Therefore, the pressure in passageway 71 will continue to rise causing valve 122 to unseat and permitting fluid flow to passageway 137.

The modified port plug 182' is usually covered with Shell Darina Grease Number 2 or other suitable lubricant to prevent plugging of the check valve 214.

In addition, because multiple packers are usually run along a tubular string comprised of tubular members 10 and other tubular members, the seal diameters should be measured and an indication of such be made, such as on the valve collar 14. In this manner the packer with the smallest upper seal 84 area will be run closest to the bottom of the hole to minimize distortion caused by different areas between seals 84 and 66 since the devices of the prior art always have a larger area for seal 84 than for seal 66.

Embodiment 2

Figure 5:
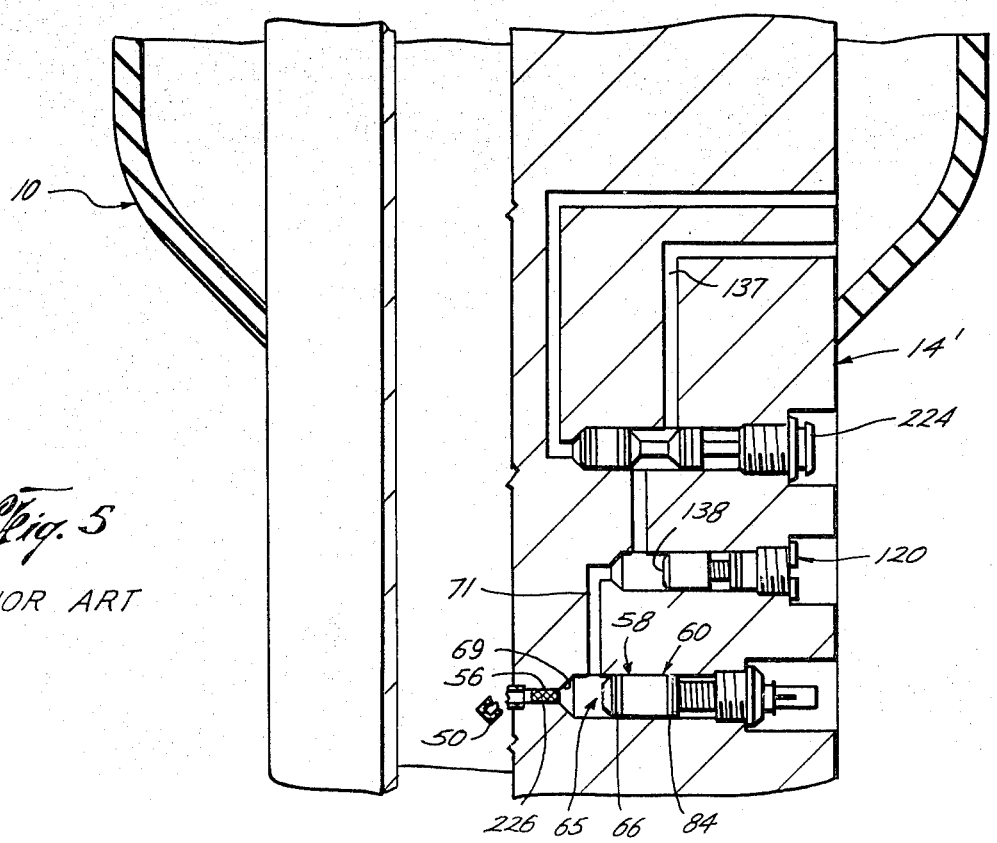
Fig. 5 PRIOR ART
FIG. 5 is a pictoral view of the cross-section of another valve arrangement of the prior art showing the valve arrangement during inflation of the packer.

Referring to FIG. 5, a different valve configuration for use with a tubular member 10 is shown in the inflated and locked position. Except for the valve collar, the rest of the elements of tubular member 10 are substantially identical and like reference numerals will be used in reference to same. As shown in FIG. 5, valve collar 14' includes three valves 58, 120, 224.

In embodiment 2, after the rod 50 is displaced, fluid again flows through passageway 54, and optionally a screen 226, and enters port 56 which is sealed by a valve 58. The problem of extrusion of seals 66 and 84 when the valve is initially lowered into the well is still a problem in the prior art of FIG. 5 except that a pocket 60' is used with the diameter of upper pocket chamber 65' is substantially identical to the diameter at lower pocket chamber 69. The problem results from the pressure in passageway 71 being substantially at atmospheric pressure when the valve collar 14 is lowered into the bore because seal 138 prevents any flow to passageway 71 from the packer channel 20 and seals 66, 84 prevent any leakage from chambers 65', 69 to passageway 71. Accordingly, the prior art arrangement as set out in FIG. 5 fails to prevent the extrusion of the seals 66, 84 and, accordingly, does not have a predictable shear valve pressure for the same reasons as set out in the description of FIG. 3.

Figure 6:
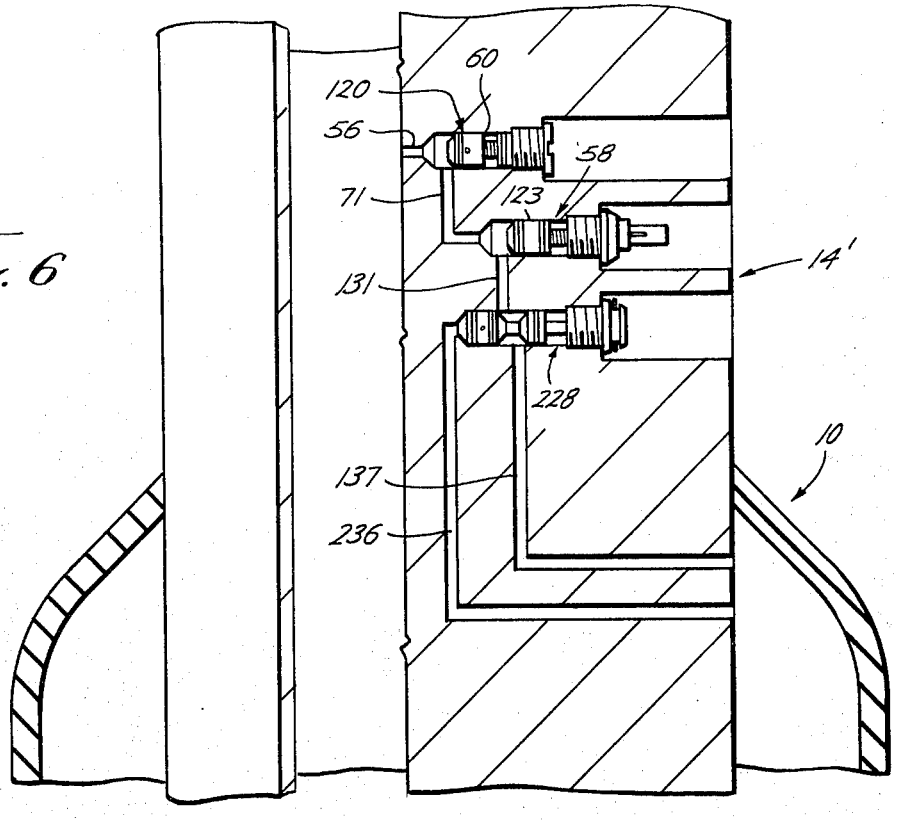
FIG. 6 is a pictoral view of the cross-section of a second embodiment of the three valves of a three-valve arrangement of the present invention within the valve collar.
Figure 7:
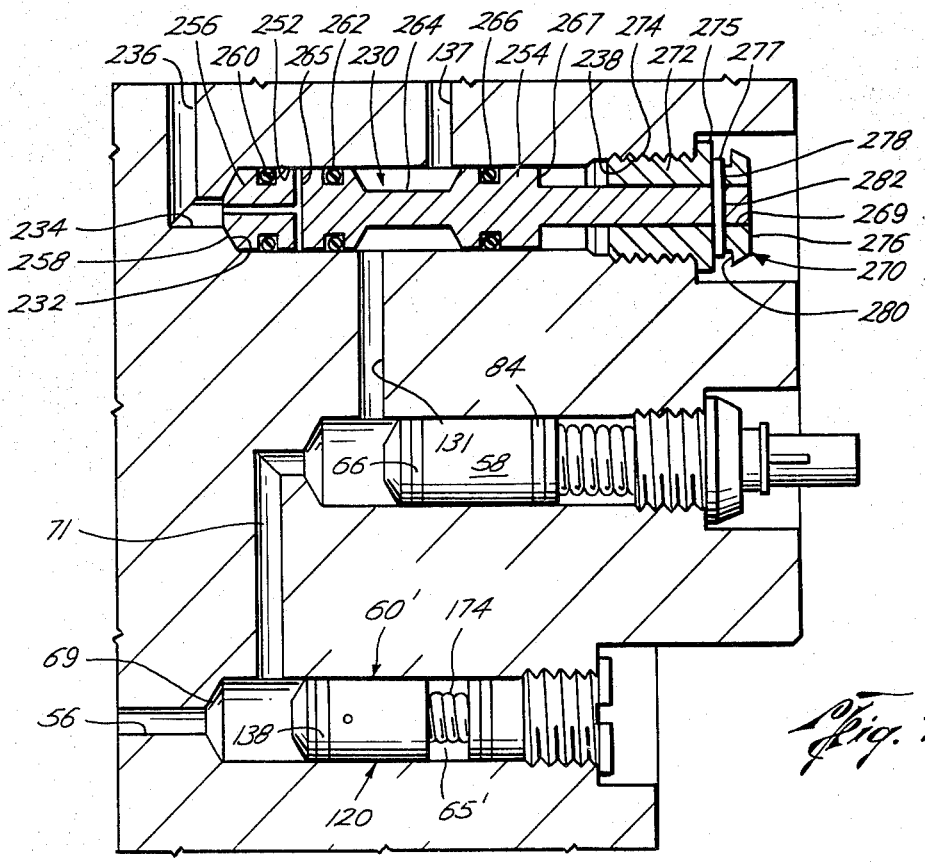
FIG. 7 is an enlarged pictoral view of a cross-section of the three valves of the three-valve arrangement of FIG. 6 shown inverted to the normal position of insertion.

As shown in FIG. 6, the present invention utilizes the same valves 58, 120 as the prior art of FIG. 5. However, valve 58 and valve 120 are interchanged in pockets 60', 123. In addition, a third valve 228 is used which is substantially different from valve 122 and is, preferably, identical to prior art valve 224 supplied by Lynes, Inc. in its External Casing Packer. As seen in FIG. 7, valve 228 is located in pocket 230.

Valve 228 includes split valve bodies, upper valve body 254 and lower valve body 256, in pocket 230. Pocket 230 is substantially longer than pocket 125, such extension being formed by a longer bore extension into valve collar 14' (the prime is used to denote a different collar 14 with substantially the same pocket and passageway configuration except as otherwise described in the description of this Embodiment 2), forming a substantial pocket chamber 252 beyond passageway 131 and eliminating port 133. Valve chamber 252 is in fluid communication with the rest of the valve pocket 230, including with passageways 131, 137. Pocket chamber 252 is cylindrical in shape with walls 231 and forms angled valve seat 232 at the end of chamber 252 in direct fluid communication with port 234 leading to a passageway 236 which is a return from the interior of packer 30. The other end of pocket 230 is threaded with threads 238.

Lower valve body 256 includes an end portion 258 shaped to fit in seat 232. First and second seals 260, 262 are adapted to engage the wall 231 of the lower chamber 252 of pocket 230. End 258 may be a separate piece and connected by external threads or other suitable means to internal threads of a longitudinal bore in the rest of the body 256. The valve body 256, as illustrated, is cylindrical in configuration and is reduced in size at the end opposite to end portion 258 to form a short valve stem 264. In addition, a relief bore 265 is drilled in body 256 between seals 260, 262 and in fluid communication with chamber 252 there between through end portion 258 and in fluid communication with port 234.

Valve stem 264 terminates at upper body member 254. Member 254 also has a seal 266 disposed about member 254 and adapted to seal against wall 231. Upper valve body 254, as illustrated, is cylindrical in configuration and is reduced in size at the end opposite stem 264 to form a valve stem 268 forming a shoulder 267 therebetween. Valve stem 268 extends through a bore 269 in a retainer housing 270 at the end of pocket 230 opposite seat 232. This end is an open portion of the external surface of valve collar 14'. Annular retainer housing 270 has a base 272 with threads 274 formed on the outer circumference thereof. Threads 274 match with threads 238 which secures housing 270 to pocket 230. Housing 270 further has a wing extension 275 in end 276 to control the length of extension of valve 228 into pocket 230.

A shear pin 277 extends through a bore 278 in a notch 280 in the end 276 of the retainer housing 270 and a bore 282 in the end of the stem 268 adjacent bore 269 as shown in FIG. 7 to retain valve 228 in the seated position adjacent seat 232 to block off fluid flow from or to port 234 and permit the flow of fluid from passageway 131 to passageway 137. The strength of shear pin 277 will determine the amount of fluid pressure necessary in port 234 to unseat the valve 228 and block the flow through the passageway 131 to passageway 137. In this regard, seals 260, 262 are located on body members 256 and spaced far enough apart from each other so that as end 267 abuts the bottom of base 272 as pressure in port 234 urges end 258 away from seat 232, seals 260, 262 will straddle passageway 131 (FIG. 8*c*).

As shown in FIGS. 8*a* and 8*b*, in operation the invention of FIG. 6 is activated initially by pressure of fluid in port 56 from the internal portion of tubular member 10 acting on end 138 of valve 120 after rod 50 is removed. Only sufficient pressure is needed to overcome the spring 174 and raise end 120 above passageway 71. Therefore, the atmospheric pressure trapped in passageway 71 will be relieved and no adverse effect would be had on the seals 66, 84. In this regard, it should be noted that before an inflatable element 30 is permitted to be lowered into a well hole, some fluid is flushed through it to make sure no air pockets exist in the assembly to prevent failure, for example, by support rubber between the casing 10 and the end assembly or extrusion of the rubber into the fluid channel 20 when the tubular member 10 is initially lowered into the well. Accordingly, as seen in FIG. 8*a*, the well pressure will act on this trapped fluid through packer 30 thereby causing it to flow through channel 20, passageway 137, pocket 230 and passageway 131 and the pressure therethrough to be approximately equal to the well pressure.

When the pressure in passageway 71 exceeds the pressure necessary to shear pin 106 (not shown in FIGS. 6–8), the shear pin 106 will shear and seal 66 will rise above passageway 13 as shown in FIG. 8*b* in the manner set out above. Fluid will then flow through passageway 131, around stem 264 of valve 224 and thence through passageway 137 into channel 20 for inflation of the packer 30. Fluid returning to passageway 236 and port 234 from packer 30 will build pressure as the packer 30 inflates until the pressure between port 234 and the valve pocket 230 exceeds the capacity of shear pin 277 (FIG. 6). As shown in FIG. 8*c*, when this occurs, shear pin 277 will shear and lower body section 256 will be moved into position adjacent passageway 131 with end 267 abutting the bottom of housing 270. In that position seals 60, 84 will straddle passageway 131 preventing further flow from passageway 131 to passageway 137 thereby locking the packer 30 in the inflated position. In this regard, bore 265 is provided for fluid communication for the chamber 252 portion between seals 260 and 262 to bore 234 and passageway 237 so that atmospheric pressure captured between these two seals 260, 262 will be vented to prevent possibility of extrusion of seals 260 and 262 from differential pressure either as a result of pressure in chamber 256 or in passageway 236. Alternatively, the portion of the lower chamber 252 opposite seal 260 when seal 260 is in its lower most position may be slightly enlarged or grooved to permit fluid communication between seals 260, 262 and passageway 236. Such enlargement or groove would be spaced such that seal 260 would rise above the enlargement or groove in its uppermost position and seal against the wall of lower chamber 252.

It all embodiments, it should be noted that the valve collar is located at the upper end of the tubular member 10 instead of the lower end. In this manner, pressure cannot be trapped between, for example, the well bottom and the packer 30 which would have an effect on the differential pressure across the valves thereby preventing the valve 224 from closing.

Embodiment 3

Referring to FIG. 9*a*, there is shown a third embodiment of the inflation control valve in a single pocket 300. The pocket 300 is bored into a valve collar 14" (the double prime is used to denote a different collar than collar 14 or 14' with substantially the same pocket and passageway configuration, except having one pocket and except as otherwise described in the description of this embodiment 3) or formed in a sleeve or other suitable location. Bore 301, first counterbore 302 and second counterbore 304, counterbores 302, 304 separated by stop wings 306, are formed by drilling or other suitable operation in pocket 300. Stop wings 306 form an upwardly facing shoulder 316 with counter bore 302 and a downwardly, outwardly facing shoulder 307 with enlarged counterbore 304. Passageways 54, 303, 137 and 236 are formed in the valve collar 14" to be in communication to interior 21 of member 10, the external surface of valve collar 14" on the outside of tubular element 10, the fluid channel 20 and the interior of packer 30, respectively, and to pocket 300. The valve element 318, which is inserted into pocket 300, includes first body member 320 having upper surface 373 and lower surface 346 located in counterbore 304, spring 322 located in bore 302, and second body element 324 having upper surface 372 and lower surface 374 located in bore 301 and counterbore 302 in the initial assembled position. Passageway 303 has a lower surface 315 substantially coplaner with spring 322 in the initial assembled position.

First body member 320 includes enlarged portion 330 having groove 332 formed thereabout for reception of seal 334 therein. Seal 334 is sized to sealingly engage the sides of counterbore 304 and the bottom surface 336 of groove 332. Stem 338, of smaller diameter than portion 330, extends from portion 330 longitudinally to the end of counterbore 304 approximately coplaner with shoulders 316. The diameter of stem 338 is substantially less than the diameter of body portion 330 and forms shoulder 340 at the interface between the steam 338 and body portion 330. Stop wings 342 extend from stem 338. Stop wings 342 extend laterally from stem 338 and are appropriately positioned along the length of stem 338 to perform as set out below. The longitudinal placement of stop wings 342 is determined by the length of shoulder 307. Stop wings 342 must be sufficiently displaced from shoulder 340 along the surface of 338 to permit wings 342 to extend above shoulder 316 when shoulder 340 meets the lower downwardly outwardly extending surface 307. A first shear pin 344, or collet or other suitable mechanism for prevention of reciprocation, extends through the surface of valve collar 14" and into the base 346 of portion 330.

Spring 322 is of any suitable material having an inner diameter larger than the diameter of stem 338 and having a collapsed length substantially equal to the distance from shoulder 316 to the lower surface 315 of passageway 314.

Upper valve element 324 includes base portion 350 having a diameter greater than the diameter of bore 301. Element 324 is reduced in size along most of the portion extending away from lower valve element 322 to form a valve stem portion 352 having a smaller diameter than bore 301 with a shoulder 354 formed at the juncture of stem 352 and base 350. Two grooves 356, 358 are formed along the circumference of stem 352 spaced such that circumferential seals 360, 362 may be fit therein sealingly engaging the walls of bore 301 and the walls 364, 366 respectively of stem 352. Grooves 356, 358 are spaced apart sufficiently so that seals 362, 366 engage the walls on either side of passage 137 when shoulder 354 abuts shoulder 368 formed between counterbore 302 and bore 301. A shear pin 369, or collet or other suitable mechanism for prevention of reciprocation, extends through the surface of valve collar 14" and into a bore 370 formed in valve stem 352 upon initial assembly.

Referring to FIGS. *9a–9c,* in operation the pressure from the internal portion of tubular member 10 is applied at passageway 54 against surface 372 of upper member 324. When this pressure is sufficient to overcome the strength of shear pin 369, shear pin 369 shears (FIG. *9b*) permitting the pressure acting on surface 372 to move member 324 longitudinally towards lower valve portion 320 and compress spring 322. Accordingly, valve seal 360 no longer prevents flow of fluid from passageway 54 to passageway 137, and fluid then flows to passageway 137 from passageway 54. Fluid in passageway 137 flows into channel 20 and thence to the interior of packer 30 and inflates packer 30. Fluid communication with the interior of the packer 30 is accomplished through passageway 236 and permits pressure to build in passageway 236. When fluid in passageway 236 has reached a predetermined pressure, greater than or equal to the pressure in passageway 303, as determined by shear pin 344 and the surface area of seal 334, shear pin 344 shears (FIG. *9c*) forcing lower member 320 to rise and the end surface 373 of upper valve member 320 to abut the surface 374 of upper valve member 324. Because the surface area of surface 346 is substantially greater than the surface area of surface 372, the pressure in passageway 236 actng on surface 346 will eventually force both lower valve member 320 and upper valve member 324 to move through their respective pockets until shoulder 340 contacts inclined surface 307. At this point, the seals 360, 362 would be again spaced around passageway 137 to prevent further flow into the passageway 137 from passageway 54 thereby retaining the inflation of the packers 30. Should there by a small loss in pressure in the passageway 236 against surface 346, the optional wings 342 would prevent lower valve member 320 and upper valve element 324 from moving sufficiently to again permit flow between passageways 54 and 137.

Although the system described in detail above is most satisfactory and preferred, many variations in structure and method are possible. For example, wings 342 may be eliminated. Also, the members may be made of any material suitable for the environment. Further, reciprocating member or upper valve element 324 may be split horizontally so that the member has two pieces, each piece having one seal and the lower seal being of a poppet type.

The above are examples of the possible changes or variations.

Because many varying and different embodiments may be made within the scope of the inventive concept herein taught and because modifications may be made in accordance with the descriptive requirements of the law, it should be understood that the details herein are to be interpreted as illustrative and not in a limiting sense.

What is claimed as invention is:

1. In a tubular system having a hollow tubular mandrel;

a packer attached to the mandrel at one end;

a valve collar mounted on the other end of the mandrel, the other end of the packer being attached to the collar and the collar being in fluid communication with the packer by a passage and the collar also being in fluid communication with the interior and exterior of the mandrel;

a valve system mounted on the mandrel, the valve system being in fluid communication with the packer and the interior and exterior of the mandrel, the valve system including at least one valve with at least one reciprocating member and a stop means for preventing reciprocation of the reciprocating member prior to the application of at least a predetermined pressure difference to the reciprocating member, the reciprocating member being located at one end of the passage when the stop means prevents reciprocation, the reciprocating member hving at least two seals thereon for preventing the flow of fluid from either side of the reciprocating member around the member to the passage;

the improvement comprising:

first means independent of the seals for permitting the flow of fluid from the interior of the mandrel to one side of one seal of the reciprocating member; and second means independent of the seals for permitting the flow of fluid from the exterior of the mandrel to oppositely facing surface of the other seal of the reciprocating member; and third means independent of the seals for equalizing the pressure on the other side of each of the seals to substantially that of the exterior of the mandrel.

2. A tubular system for use in packing off a well bore, comprising:

a hollow tubular mandrel;

a packer attached to said mandrel at one end of said mandrel;

a valve collar mounted on the other end of said mandrel, the other end of said packer being attached to said collar and having a passageway therethrough, and said collar being in fluid communication with said packer and the interior and exterior of said mandrel by said passageway;

said passageway having enlarged portions in said collar;

a valve system mounted in said enlarged portions, said valve system including three valves;

the first of said valves being mounted in the first of said portions and having a reciprocating member and a stop means for preventing reciprocation of said reciprocating member prior to the application of at least a predetermined difference in pressure between one side of said reciprocating member and the other side, said reciprocating member being located at one end of a first part of said passageway when said stop means prevents reciprocation and having at least two seals thereon for preventing the flow of fluid from either end of said reciprocating member around the member to said first passageway part;

said first valve being in fluid communication with a second part of said passageway in fluid communication with said interior of said mandrel on one side of said reciprocating member;

said first valve being in fluid communication with said exterior of said mandrel on the other side of said reciprocating member; and the second of said valves having check means for permitting the flow of fluid from said exterior of said mandrel to said first part of said passageway when the pressure in said mandrel exceeds the pressure in said second portion.

3. The system of claim 2, wherein said second portion includes a first bore opening to said exterior of said mandrel and said second valve is located in said first bore.

4. The system of claim 3, wherein said second valve uncludes:

a head adapted to connect to said first bore;

a seal mounted on said head and sealingly engaging the walls of said first bore and said head; and said check means is mounted in said head.

5. The system of claims 2, 3 or 4 wherein the remainder of said second portion is filled with a liquid.

6. The system of claims 1, 2, 3 or 4 wherein;

said third valve is mounted in a third of said portions, said third portion being in fluid communication with said exterior of said mandrel and a third part of said passageway in fluid communication between said second portion and said third portion and a fourth part of said passageway in fluid communication with said packer;

said third valve including first seal means for preventing fluid communication between said third portion and said exterior of said mandrel, and second seal means for preventing fluid communication between said third part and said fourth part when the pressure in said fourth part is greater than the pressure in said third part.

7. A tubular system for use in packing off a well bore, comprising:

a hollow tubular mandrel;

a packer attached to said mandrel at one end of said mandrel having an interior portion separated from said mandrel and an inlet to said interior portion;

a valve collar mounted on other end of said mandrel and having a passageway therethrough, the other end of said packer being attached to said collar, and said collar being in fluid communication with said inlet to said packer, said interior portion of said packer and the interior and exterior of said mandrel by said passageway;

said passageway having enlarged portions in said collar, including a first portion in fluid communication with a first part of said passageway in fluid communication with interior of said mandrel, a second portion in fluid communication with said external part of said mandrel and a second part of said passageway in fluid communication with said first portion, and a third portion in fluid communication with a third part of said passageway in fluid communication with said second portion, said third portion also being in fluid communication with a fourth part of said passageway in fluid communication with said interior at said packer and a fifth part of said passageway in fluid communication with said inlet to said packer;

a valve system mounted in said enlarged portions;

said valve system including three valves;

the second of said valves being mounted in said second portion and having a reciprocating member and a stop means for preventing reciprocation of said reciprocating member prior to the application of at least a predetermined difference in pressure between one side of said reciprocating member and the other side, said reciprocating member being located at one end of said second part when said stop means prevents reciprocation and having at least two seals thereon for preventing the flow of fluid from either end of said reciprocating member around said member to said third part.

8. The system of claim 7 wherein:

said second valve seals are mounted to avoid prevention of flow between said second portion and said third portion through said third part when said stop means permits reciprocation.

9. The system of claims 7 or 8 wherein:

said first valve is mounted in said first portion, said first valve including first seal means for preventing fluid communication between said first portion and said exterior of said mandrel, and second seal means for preventing fluid communication between said first part and said second part when the pressure in said second part is greater than the pressure in said first part.

10. The system of claims 7 or 8 wherein:

said third portion is in fluid communication with said exterior of said mandrel;

said third valve is mounted in said third portion and includes a second reciprocating member and a third reciprocating member connected by a stem and a second stop means for preventing reciprocation of said reciprocating members prior to the application of at least a predetermined pressure difference between one side of said second reciprocating member and the oppositely facing side of said third reciprocating member, said second reciprocating member having two seals thereon and being positioned in said third portion so that at least one of said seals prevents fluid flow between said fourth part and said third portion when said stop means prevents reciprocation;

said third reciprocating member includes third seal means for preventing fluid communication between a portion of said third portion and said exterior of said mandrel; and said seals thereon being spaced for preventing the flow of fluid from either side of said second reciprocating member to said third part after said second stop means no longer prevents reciprocation, said seals being positioned to permit flow from said third part to said fifth part about said stem when said second reciprocating member is prevented from reciprocating by said second stop means.

11. The system of claim 10 wherein there is further included a small, relief passage between said two seals of said second reciprocating member and one of the ends of said second reciprocating member.

12. A tubular member for use in a bore, comprising:

a packer attached to said mandrel at one end of said mandrel having an interior portion separated from said mandrel;

a valve collar mounted on the other end of said mandrel and having a passageway therethrough, the other end of said packer being attached to said collar, and said collar being in fluid communication with said interior of said packer by a passage and the interior and exterior of said mandrel;

said passage having at least one enlarged portion forming a part in said collar;

a valve system mounted in said enlarged portion, said valve system being in fluid communication with the interior of said packer and the interior and exterior of said mandrel;

said valve collar being adapted to be inserted at the end of said mandrel that is last to enter the bore.

13. A tubular system for use in packing off a well bore, comprising:

a hollow tubular mandrel;

a packer attached to said mandrel at one end of said mandrel having an interior portion separated from said mandrel and an inlet to said interior portion;

a valve holder mounted on other end of said mandrel and having a passageway therethrough, the other end of said packer being attached to said valve holder, and said valve holder being in fluid communication with said inlet to said packer and the interior and exterior of said mandrel by said passageway;

said passageway having an enlarged portion in said valve holder, said portion being in fluid communication with:

a first part of said passageway in fluid communication with interior of said mandrel, said external part of said mandrel, and a second part of said passageway in fluid communication with said inlet to said packer;

a valve system mounted in said enlarged portion, said valve system including at least one valve, said valve being mounted in said portion and having a reciprocating member and a stop means for preventing reciprocation of said reciprocating member prior to the application of at least a predetermined difference in pressure between one side of said reciprocating member and the other side, said reciprocating member being located at one end of said portion when said stop means prevents reciprocation and having at least two seals thereon for preventing the flow of fluid from either end of said reciprocating member around said member to said second part;

each of said seals being exposed on one side thereof to fluid from said second part.

* * * * *